US005467923A

United States Patent [19]

Potuznik et al.

[11] Patent Number: 5,467,923

[45] Date of Patent: Nov. 21, 1995

[54] METHOD AND DEVICE FOR THE MONOLITHIC APPLICATION OF A THERMAL-INSULATION AND/OR FIRE-PROTECTION COMPOUND TO A SURFACE

[75] Inventors: Walter Potuznik, Vienna; Josef Himmel, Maria Enzersdorf, both of Austria

[73] Assignee: Burian Gesellschaft m.b.H. & Co. KG, Vienna, Austria

[21] Appl. No.: 122,439

[22] PCT Filed: Nov. 4, 1992

[86] PCT No.: PCT/AT92/00137

§ 371 Date: Sep. 23, 1993

§ 102(e) Date: Sep. 23, 1993

[87] PCT Pub. No.: WO93/16250

PCT Pub. Date: Aug. 19, 1993

[30] Foreign Application Priority Data

Feb. 17, 1992 [AT] Austria ..... 266/92

[51] Int. Cl.[6] ..... E04F 21/12

[52] U.S. Cl. ..... 239/8; 239/427.5; 239/428; 406/120

[58] Field of Search ..... 239/8, 428, 433, 239/434, 419, 419.3, 427–427.5; 406/39, 53, 56, 120, 130, 144, 46, 47, 49

[56] References Cited

U.S. PATENT DOCUMENTS

| | | | |
|---|---|---|---|
| 2,929,436 | 3/1960 | Hampshire | 239/428 |
| 3,070,403 | 12/1962 | Shelton-V | 406/120 |
| 3,676,170 | 7/1972 | Kempthorne | 239/433 |
| 3,740,260 | 6/1973 | Winn, Jr. | 239/428 |
| 3,829,016 | 8/1974 | Scharfenberger | 239/127 |
| 3,907,170 | 9/1975 | Schedrin et al. | 406/47 |
| 3,957,209 | 5/1976 | Thomson | 239/433 |
| 4,249,839 | 2/1981 | Vance | 406/120 |
| 4,419,256 | 12/1983 | Loomis | 252/62 |
| 4,530,468 | 7/1985 | Sperber | 239/428 |
| 5,224,654 | 7/1993 | von Eckardstein | 239/427.5 |

FOREIGN PATENT DOCUMENTS

| | | |
|---|---|---|
| 181425 | 1/1880 | Czechoslovakia . |
| 0378437 | 7/1990 | European Pat. Off. . |
| 2414369 | 11/1980 | France . |
| 1930919 | 12/1970 | Germany . |
| 2156096 | 5/1972 | Germany . |
| 2706433 | 8/1977 | Germany . |
| 2601368 | 5/1979 | Germany . |
| 657408 | 8/1986 | Switzerland . |
| 663804 | 5/1979 | U.S.S.R. . |
| 2193118A | 2/1988 | United Kingdom . |

OTHER PUBLICATIONS

Russian article, pp. 122, 125, 126, and 127, dated 1971.

*Primary Examiner*—Karen B. Merritt
*Attorney, Agent, or Firm*—Herbert Dubno

[57] ABSTRACT

The invention relates to a method and a device for applying an insulating and/or fireproofing compound monolithically onto a surface, wherein in a feed channel (1) a pneumatic conveyor (2) generates a moving air volume, into which are introduced an insulating and/or fireproofing material and a hardening agent (4) which pass with the air volume into a spray pistol (5), which is connected to the feed channel (1) and in which, just upstream of the nozzle-like outlet (6), a gaseous pressure medium (7) and binding agent or adhesive (8) are introduced.

4 Claims, 2 Drawing Sheets

METHOD AND DEVICE FOR THE MONOLITHIC APPLICATION OF A THERMAL-INSULATION AND/OR FIRE-PROTECTION COMPOUND TO A SURFACE

CROSS REFERENCE TO RELATED APPLICATIONS

This application is a national phase of PCT/AT92/00137 filed 4 Nov. 1992 and based, in turn, upon Austrian application A 266/92 of 17 Feb. 1992 under the International Convention.

FIELD OF THE INVENTION

The invention relates to a method of applying an insulating and/or fireproofing compound monolithically onto a surface and to a device for effecting said method.

BACKGROUND OF THE INVENTION

For some time now it has been known that asbestos is a health hazard and should therefore be avoided in the building and construction industry, particularly for enclosed interior spaces. On the other hand, asbestos-containing building materials are fire-resistant, which makes their multi-layered use in the form of solid structural elements and in the form of liquid materials for pouring or spraying understandable. In addition, asbestos is a poor conductor of heat and so provides a certain degree of heat insulation.

Following recognition of the health risks of asbestos, attempts were made to find substitute materials with, above all, equally good fire-resistant properties. Such materials with equally good fireproofing properties are, for example, vermiculite and perlite which are additionally kind to the skin and do not require special protection when handled and moreover offer a high degree of sound and heat insulation. Rock wool or the like, which likewise only requires minimal protective measures during processing, is also used for insulation purposes.

Despite strenuous efforts, it has until now proved impossible with the above-mentioned materials to produce an insulating and/or fireproofing compound which may be applied monolithically onto a smooth surface without a wash primer and without mechanical fastening means, e.g. as a spray plaster.

OBJECT OF THE INVENTION

The object of the invention is to provide a method and a device which allow an insulating and/or fireproofing compound to be applied monolithically onto a surface.

SUMMARY OF THE INVENTION

This object is achieved in that in a feed channel a pneumatic conveyor generates a moving air volume, into which are introduced an insulating and/or fireproofing material and a hardening agent which pass with the air volume into a spray pistol, which is connected to the feed channel and in which, just upstream of the nozzle-like exit, a gaseous pressure medium and a binding agent or an adhesive are introduced. The insulating and/or fireproofing compound thereby produced may be applied monolithically and durably onto a surface and preserves the properties specific to the insulating and/or fireproofing materials.

In particular, first the insulating and/or fireproofing material and then separately a hardening agent, preferably in powder form, are introduced into the air volume.

The method according to the invention is particularly suitable for insulating and/or fireproofing materials which have a lower specific weight than the binding agent, because the relatively light insulating and/or fireproofing material may be transported without difficulty in the air volume and the relatively heavy binding agent or the relatively heavy adhesive may be added later.

Suitable insulating and/or fireproofing materials are vermiculite, perlite or rock wool and the like.

An adhesive, in particular a fire protection adhesive, may be used as a binding agent.

At the start of the method, switching on of the pneumatic conveyor, the start of the supply of insulating and/or fireproofing material, of hardening agent and of binding agent or adhesive is preferably delayed by a control unit in each case in accordance with the specific weight and the feed distance. Delaying the supply of the individual components compensates the differences in the acceleration times owing to the differing specific weights and the differences in the distances of the feed points from the outlet nozzle of the spray pistol. After their acceleration phase, all of the components have the same velocity, namely that of the air volume, thereby achieving uniform transport of the components.

The device according to the invention comprises in that a pneumatic conveyor connected by its intake side to one end of a feed channel, into which at least one delivery device for an insulating and/or fireproofing material and for a hardening agent opens. The pneumatic conveyor at its delivery side has a connection for a tube, on the end of which is disposed a spray pistol, into which a tube for supplying a gaseous pressure medium and a supply line for binding agent or adhesive open out. The insulating and/or fireproofing material and the hardening agent are not blown through the feed channel - which with many light materials would be impossible or difficult owing to their specific weight - but are drawn in with the moving air volume.

At its other end, the feed channel preferably has a control flap for controlling the air quantity in the feed channel.

Opening into the feed channel there is preferably one delivery device each for the insulating and/or fireproofing material and for the hardening agent. Owing to said materials being added separately, it is possible to alter the mixing ratio at any time. The metered delivery may be effected, for example, in the case of the delivery device for the hardening agent by a motor-driven worm and in the case of the delivery device for the insulating and/or fireproofing material by means of a pneumatic valve.

An electronic control device is provided for controlling said delivery devices for the insulating and/or fireproofing material and the hardening agent, the delivery device for the binding agent or the adhesive, the supply of pressure medium and the pneumatic conveyor. Thus, with a preselected feed quantity and mixing ratio, the device is simple to operate and the operating output remains constant.

BRIEF DESCRIPTION OF THE DRAWING

The above and other objects, features, and advantages will become more readily apparent from the following description, reference being made to the accompanying drawing in which.

Figure 1:
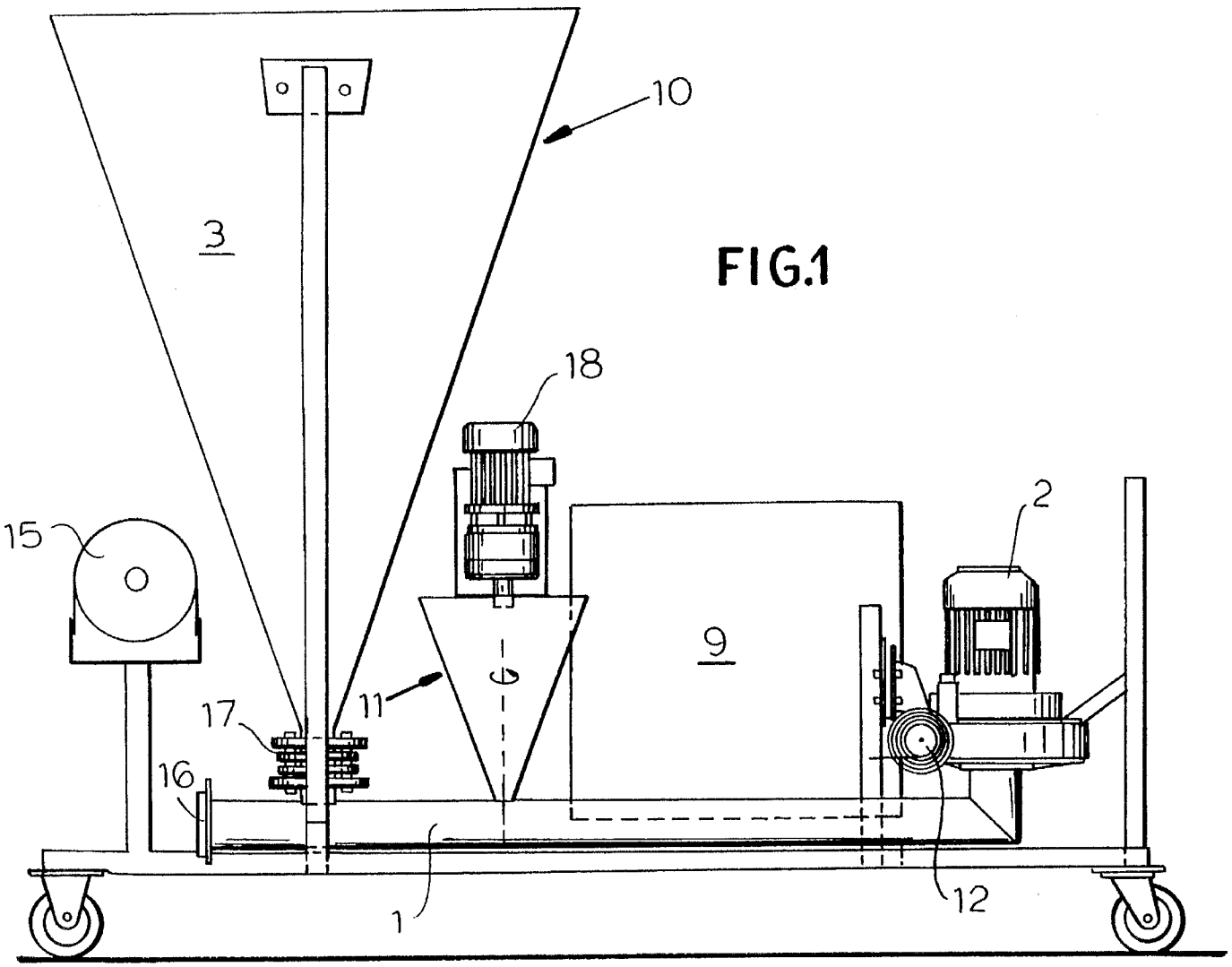
FIG. 1 is a side elevational view of an apparatus for feeding the flow of air with the pulverulent mixture to the spray nozzle.
Figure 2:
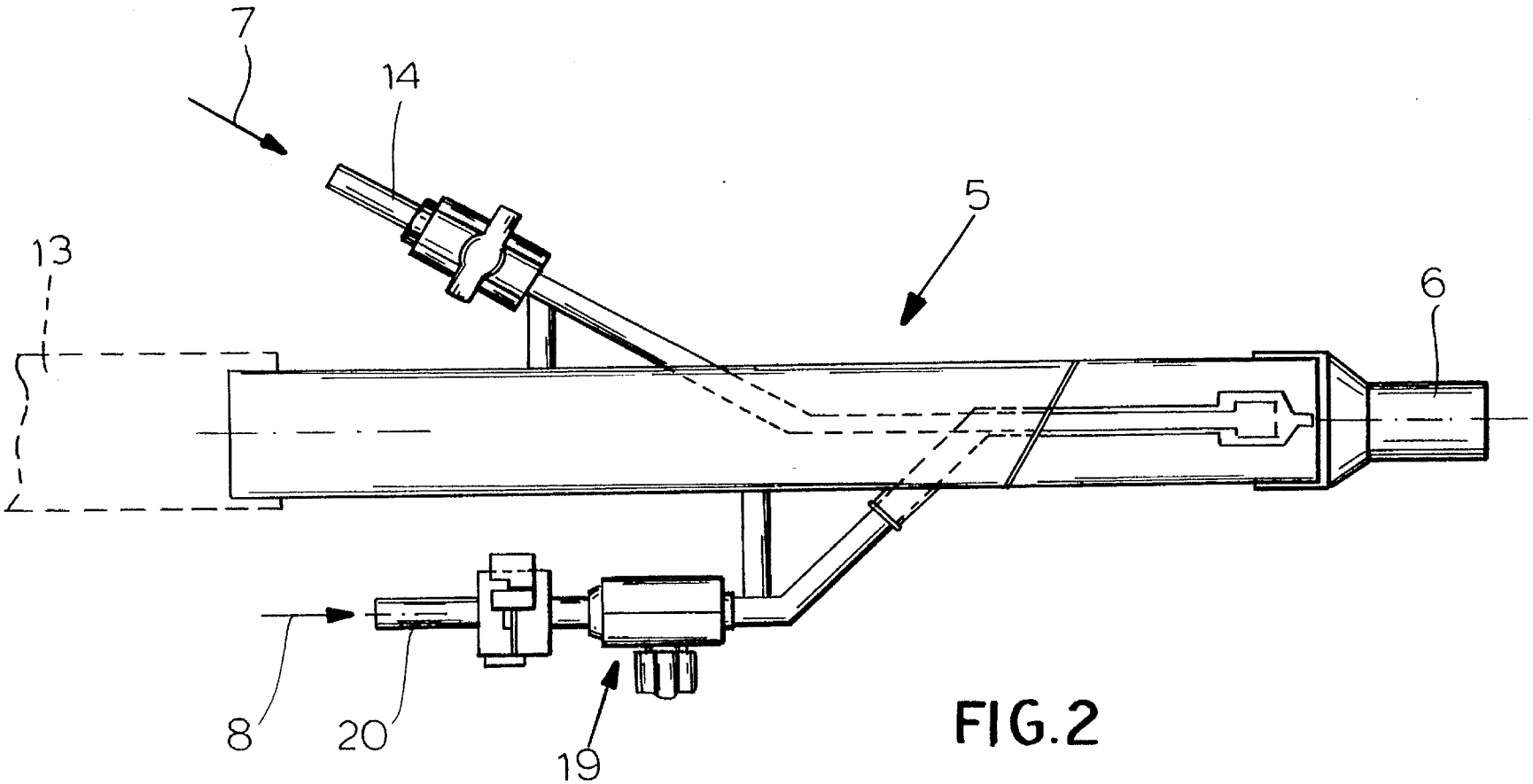
FIG. 2 is a diagrammatic elevational view showing the spray nozzle.

As FIG. 1 shows, a pneumatic conveyor 2 is connected to one end of a feed channel 1 on the one hand and to a connection 12 on the other hand. At its other end, the feed channel 1 has a control flap 16. Delivery devices 10, 11 for an insulating and/or fireproofing material 3 and a hardening agent 4 respectively open out between the control flap 16 and the pneumatic conveyor 2. Delivery of the insulating and/or fireproofing material 3 is controlled by a pneumatic valve 17 and delivery of the hardening agent 4 is controlled by a worm driven by a motor 18. A tube 13 leads from the connection 12 to the spray pistol 5 shown in FIG. 2, into which compressed air 7 from a compressed-air delivery device 15 is introduced via a tube 14 on the one hand and a binding agent or adhesive 8 is introduced via a line 20 and a valve 19 on the other hand.

At the start of work, switching-on of the device via the control unit 9 effects starting of the pneumatic conveyor 2. As soon as a moving air volume has built up, the delivery device 10 is activated by the control unit 9 and a constant quantity of insulating and/or fireproofing material 3 is introduced into the air volume, then, after a certain time delay, the delivery device 11 is activated and a constant quantity of hardening agent 4 is likewise introduced into the mixture of air and insulating and/or fireproofing material. The pneumatic conveyor 2 draws in the air volume with the insulating and/or fireproofing material 3 and the hardening agent 4 and transports it to the spray pistol 5. There, again after a certain time delay, binding agent or adhesive 8 is admixed. Owing to the various specific weights of insulating and/or fireproofing material 3, hardening agent 4 and binding agent or adhesive 8, said individual components have different acceleration times in the air volume, these being compensated by the electronic control system. The effect achieved by the time delays when the delivery devices are switched on at the start of work is that, from the very beginning, the mixture squirted with the gaseous pressure medium out of the nozzle-like outlet 6 has the preselected mixing ratio, i.e. is immediately fit for processing. When the device is switched off, the control unit 9 arranges the disconnection of the individual delivery devices and the pneumatic conveyor in the reverse order so that there is no wastage at the end of work either.

For example, in corresponding experiments to manufacture the test surfaces for the test programs according to Austrian standards B 3800 and S 5104, vermiculite with a grain size of 3 to 6 mm, hardening agent in powder form and the solvent-free, Burian steel fire protection adhesive manufactured by Burian GmbH & Co. KG were used.

The experiments demonstrated that the insulating and fireproofing compound manufactured from the above-mentioned materials using the method according to the invention is fire-resistant according to fire resistance class F90, highly fire-retardant according to fire resistance class F60, with little smoke development (smoke development class Q1) and low drop formation (drop formation class Tr1), as well as having a good sound-absorbing effect.

Further tests using said insulating and fireproofing compound established not only its good fire protection, soundproofing and noise protection properties but also its suitability as high- or low-temperature insulation.

We claim:

1. A method of applying a monolithic fire-resistant insulating coating to a structure, comprising the steps of:

(a) generating a constant flow of air by suction;

(b) feeding into said constant flow of air at an upstream location therealong at least one fire-retardant insulating material selected from the group which consists of vermiculite, perlite and rock wool;

(c) feeding into said constant flow of air at a location downstream from said upstream location a pulverulent hardener, thereby forming a mixture of said fire-retardant insulating material and said hardner in said constant flow of air;

(d) then blowing said flow of air with said mixture therein through a conduit to a nozzle;

(e) feeding compressed air to said nozzle separately from said flow of air and said mixture and through a pipe separate from said conduit;

(f) supplying a binding agent to said nozzle through a line separate from said pipe and said conduit and forming a coating composition by combining said mixture with said binding agent in said nozzle; and (g) spraying said composition onto said structure from said nozzle with said compressed air.

2. The method defined in claim 1, further comprising the step of controlling the timing of addition of said fire-resistant insulating material and said hardner to said flow of air and the supply of said binding agent to said nozzle in accordance with the respective specific weights and paths thereof.

3. An apparatus for supplying a monolithic fire-resistant insulating coating to a structure comprising:

a conduit adapted to communicate with the atmosphere at one end;

a blower having an intake side connected to an opposite end of said conduit for generating a constant flow of air by suction therethrough;

means for feeding into said conduit and said constant flow of air at an upstream location therealong at least one pulverulent fire-retardant insulating material selected from the group which consists of vermiculite, perlite and rock wool;

means for feeding into said constant flow of air and said conduit at a location downstream from said upstream location a pulverulent hardner, thereby forming a mixture of said fire-retardant insulating material and said hardner in said constant flow of air, said blower having a discharge side from which said mixture is discharged in said flow of air;

a duct connected to said discharge side of said blower;

a spray nozzle connected to said duct for receiving said mixture and said flow of air therefrom;

means including a pipe separate from said duct for feeding compressed air to said nozzle separately from said flow of air and said mixture; and means including a line separate from said pipe and said duct for supplying a binding agent through said nozzle and forming a coating composition by combining said mixture with said binding agent in said nozzle, said composition being sprayed onto the structure from said nozzle with said compressed air.

4. The apparatus defined in claim 3 wherein said one end of said conduit is formed with a control flap, said means for feeding said pulverulent hardner into said conduit includes a motor driven worm; and said means for feeding said material into said conduit includes a compressed air valve.

* * * * *